US008021077B2

(12) United States Patent
Annese et al.

(10) Patent No.: US 8,021,077 B2
(45) Date of Patent: Sep. 20, 2011

(54) SELF-MOVED DEVICE FOR COLOURING OR SPRAYING A SURFACE

(76) Inventors: Barbara Annese, Bolzano (IT); Marco Scianame', Bolzano (IT)

( * ) Notice: Subject to any disclaimer, the term of this patent is extended or adjusted under 35 U.S.C. 154(b) by 318 days.

(21) Appl. No.: 12/297,003

(22) PCT Filed: Apr. 16, 2007

(86) PCT No.: PCT/IB2007/051353

§ 371 (c)(1),
(2), (4) Date: Oct. 13, 2008

(87) PCT Pub. No.: WO2007/119219

PCT Pub. Date: Oct. 25, 2007

(65) Prior Publication Data

US 2009/0114738 A1 May 7, 2009

(30) Foreign Application Priority Data

Apr. 14, 2006 (IT) ..... BZ2006A0012

(51) Int. Cl.
*E01C 23/16* (2006.01)

(52) U.S. Cl. ..... 404/93; 404/94; 118/305; 239/73; 239/150; 239/165; 239/172; 239/176

(58) Field of Classification Search ..... 239/146–176, 239/73; 118/301–313; 404/93, 94
See application file for complete search history.

(56) References Cited

U.S. PATENT DOCUMENTS

| | | | | |
|---|---|---|---|---|
| 2,691,923 | A * | 10/1954 | Huck | 404/94 |
| 5,054,959 | A * | 10/1991 | Wilson et al. | 404/94 |
| 5,540,516 | A | 7/1996 | Nicodemo et al. | |
| 6,729,706 | B1 * | 5/2004 | Patton et al. | 347/2 |
| 7,237,783 | B2 * | 7/2007 | Kieffer et al. | 280/47.34 |
| 2004/0057795 | A1 * | 3/2004 | Mayfield et al. | 404/84.05 |

FOREIGN PATENT DOCUMENTS

| | | |
|---|---|---|
| FR | 2746823 | 10/1997 |
| JP | 2000-001811 | 7/2000 |
| WO | 02/28541 | 4/2002 |
| WO | 02/076562 | 10/2002 |

OTHER PUBLICATIONS

PCT International Search Report for PCT/IB2007/051353 filed on Apr. 16, 2007 in the name of Barbara Annese.
PCT Written Opinion for PCT/IB2007/051353 filed on Apr. 16, 2007 in the name of Barbara Annese.

* cited by examiner

*Primary Examiner* — Dinh Nguyen
(74) *Attorney, Agent, or Firm* — Steinfl & Bruno LLP

(57) ABSTRACT

A self-moved device (1) suitable for spraying a fluid substance on a surface (50), comprising a moving system (6) for motion on the surface (50), at least one tank (4) suitable for containing said fluid substance, a spraying system (5) for spraying the fluid substance, a management and control system (7) for managing and controlling said moving system (6) and said spraying system (5), wherein the management and control system (7) is suitable for guiding the motion of said self-moved device (1) on said surface (50) and for activating said spraying system (5) in a plurality of spots of said surface (50) according to a predetermined scheme.

11 Claims, 3 Drawing Sheets

SELF-MOVED DEVICE FOR COLOURING OR SPRAYING A SURFACE

CROSS REFERENCE TO RELATED APPLICATIONS

The present application is the US national stage of International Application PCT/IB2007/051353 filed on Apr. 16, 2007 which, in turn, claims priority to Italian Application BZ2006A000012, filed on Apr. 14, 2006.

The present invention refers to a self-moved device for colouring or spraying fluid substances on surfaces.

There is often the need to make colourings and/or graphic elements on surfaces of various natures, be them plane or sloping. Consider, e.g., the case of a road, on which roadway boundary lines and centre lines, road markings, directions or any information writings have to be made.

Again, consider a sports ground, e.g. a turf soccer ground, onto which there have to be made boundary lines and all other elements required for playing. Or, consider a golf course, in which different areas functional to playing are denoted by different shades of green, often made by means of grass colouring.

In other cases it is desirable to originally and strikingly spread information or ads, e.g. by reproducing such messages in a large-scale on large-size surfaces, like e.g. sports grounds, squares, meadows, slope sides, etc.; this is often carried out by means of colouring said surfaces.

A further option is had when it is desirable to selectively apply a fluid product, like e.g. water, a fertiliser or a herbicide, on a turf to the extent of some of its parts or along a prearranged path, so as to attain specific visual effects due to a different growth of the grass.

Evidently, other application fields may be added to the above-reported ones, all having in common the need to selectively distribute a fluid product on a surface, be it plane or sloping.

The above-mentioned steps are usually carried out manually or anyhow by means of manually driven instruments. E.g., in the case of road markings, those are often made by means of ground-placed masks, so as to define contours of areas that have to be coloured. In other cases carts may be used, provided with a paint-holding tank and a delivery system manually controlled by the operator driving the cart itself.

Such known-art systems are therefore less than practical, requiring constant human intervention and a certain amount of labor. In addition, their use can prove tiring for the operator, above all on particularly hot or sultry days. Moreover, it should be borne in mind that during the colouring job the operator is exposed to inhalation of solvents released by the sprayed paint, solvents that in some cases could entail health troubles or harms.

Furthermore, above all in the case of complex patterns, like, e.g., a logo or an ad, a substantially manual implementation of the same by an operator might require a remarkable technical skill, be exposed to implementation errors and anyhow not lending itself easily to be standardised and identically reproduced in a rapid and inexpensive manner.

Object of the present invention is to solve the above-mentioned drawbacks of the known art, by providing a self-moved device according to claim 1. Secondary features of the present invention are defined in the corresponding independent claims thereof.

A first advantage of the present invention lies in providing a self-moved device allowing the carrying out of colourings (or the delivery of fluid substances) on surfaces, minimizing the required labor.

A second advantage of the present invention lies in providing a self-moved device requiring no operator driving.

Another advantage of the present invention lies in providing a self-moved device of versatile use.

Yet another advantage of the present invention lies in providing a self-moved device allowing the carrying out of colourings (or the delivery of fluid substances) on surfaces in an accurate and easily reproducible manner.

Further advantages, features and operation steps of the present invention will be made apparent in the following detailed description of an embodiment thereof, given by way of example and not for limitative purposes. Reference will be made to the figures of the annexed drawings, wherein.

Figure 1:
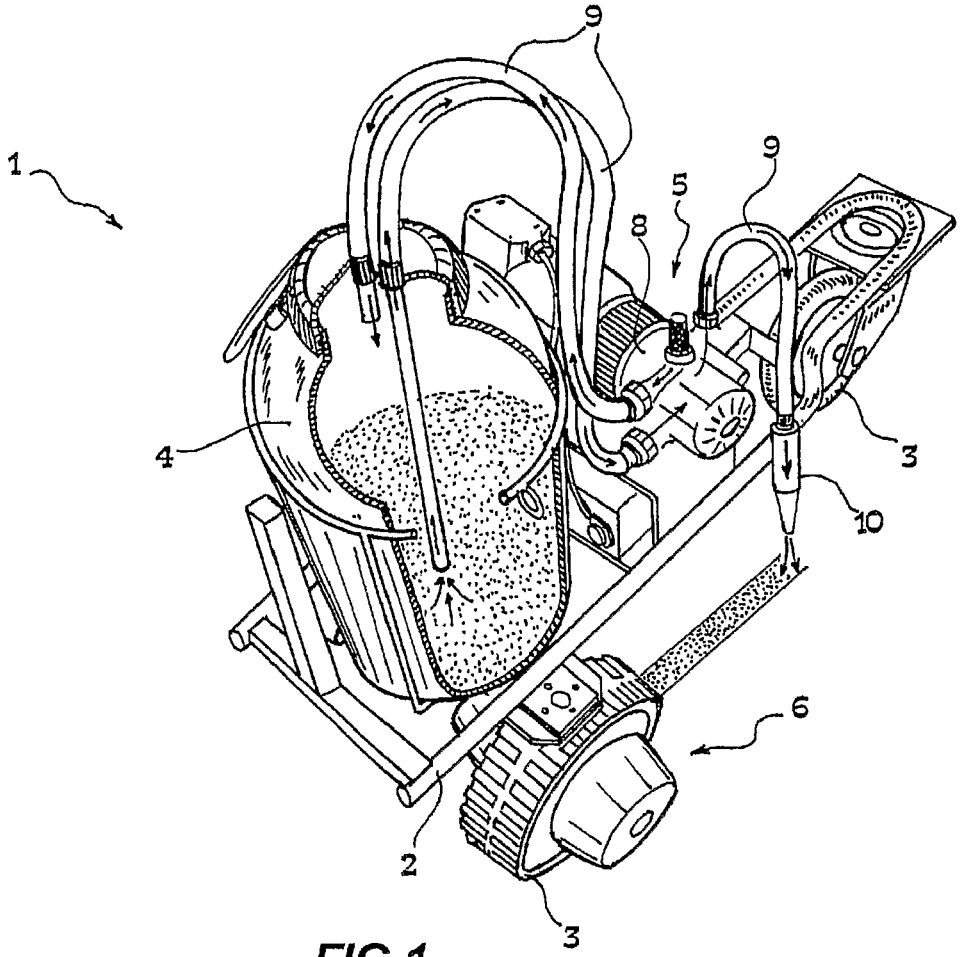
FIG. 1 shows a perspective view of a self-moved device according to the present invention.

A self-moved device 1 according to the present invention is shown in FIG. 1, and it comprises a chassis 2 mounted on wheels 3, a tank 4 for paint or other fluid substance, a spraying system 5 for spraying said paint or other, a moving system 6, a management and control system 7 comprising an electronic device.

Said wheels 3 may be three in number, four in number, or optionally in a greater number; anyhow, they are arranged so as to allow the self-moved device 1 to stably rest on a surface 50 and to easily move thereon. In particular, at least one of said wheels 3 is pivoting, so as to allow the self-moved device 1 to change its path and also to perform 360° rotations on said surface 50.

Figure 2:
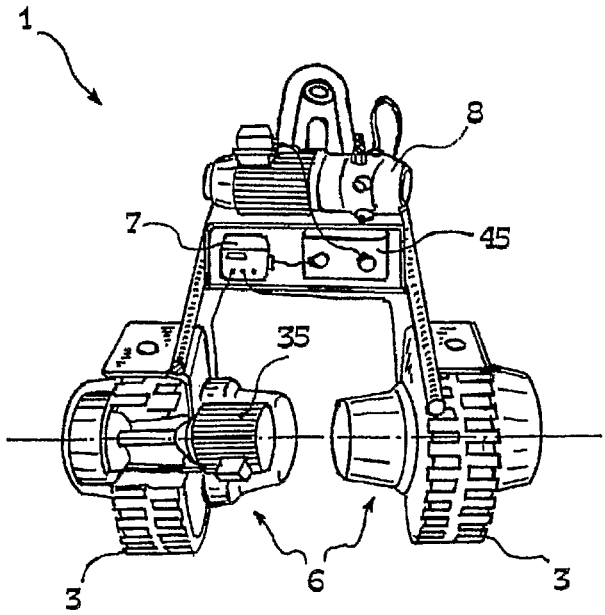
FIG. 2 shows a perspective view of a detail of the self-moved device of FIG. 1.

As shown in FIG. 2, in the preferred embodiment two of said wheels 3 are autonomously driven wheels, each comprising also an engine 35, rechargeable power-supplying batteries and an electronic control device. Said driven wheels are mounted so as to be independent therebetween and optionally steering; their motion is controlled and coordinated by said management and control system 7. Thus, the motion of the self-moved device 1 can be made possible in a simple and effective manner, using a small number of components and therefore with reasonable dimensions.

Alternatively, said autonomously driven wheels may be replaced by equivalent systems or by a system comprising an engine fixed to the chassis 2, a motion transmission device and a steering device, them also controlled by said management and control system 7. In case an internal-combustion engine is used, a fuel tank will further be required; in case the motor is an electromotor, it could be power-supplied by means of rechargeable batteries carried by the self-moved device 1 itself or by means of a cable.

Said spraying system 5 for spraying paint or other comprises a pump 8, connecting pipes 9 and spray nozzles 10. The type of pump 8 and the shape and arrangement of the nozzles 10 could be selected and/or made in different ways depending on application needs, anyhow falling within the known art and therefore not further detailed herein.

In case it is desirable to spray a plurality of colour paints or of other fluid substances, it will correspondingly be provided a plurality of suitably modified tanks 4 and spraying systems 5 (optionally, a distinct spraying system 5 for each coloured substance or paint).

Were it desirable to make colourings comprising a broad colour range, there might, e.g. be provided three tanks 4 for paints of the three primary colours (yellow, cyan blue and magenta red), optionally two additional tanks 4 for white and black paints, precision pumps for the collecting from each tank 4, a system for mixing said paints, pump 8 and spray nozzles 10 for spraying the mixture of paints. The attainment of the desired colour is possible by means of an electronic system managing the collecting of a given amount of paint per each colour and the subsequent mixing thereof; such given amounts are calculated depending on the desired colour by means of a suitable software.

The spraying of said paint or fluid substance on the surface 50 according to a predetermined scheme could be carried out according to several guidance system modes, some of them described hereinafter by way of example.

Figure 3A:
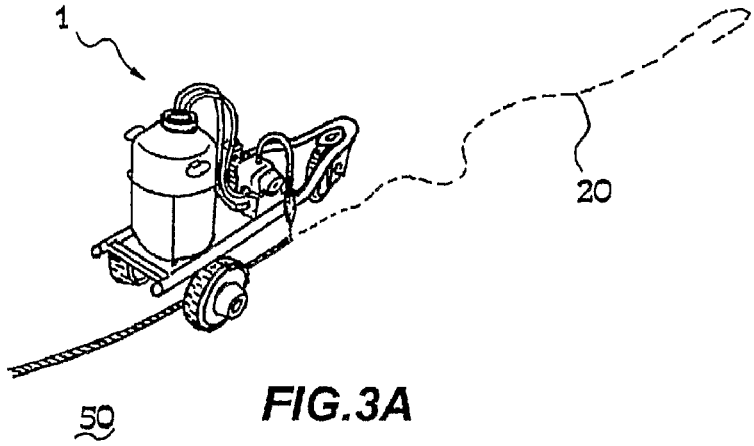
FIG. 3A shows the self-moved device of FIG. 1 with a wire-operated guidance system.

According to a first guidance system shown in FIG. 3A, the path that has to be followed by said self-moved device 1 is made by means of a lead wire 20 that is laid on the surface 50 along the path itself; said wire 20 could be rested on and/or secured to said surface 50, or optionally laid underground at a depth of some centimeters. During the spraying step, an electric potential difference is applied to said wire 20; therefore, the latter is crossed by an electric current (e.g. sinusoidal and/or low-voltage) thereby generating a magnetic field.

A suitable sensor (not shown) located on the self-moved device 1 detects the presence and the extent of said magnetic field, and transmits the yielded signal to said management and control system 7; therefore, by comparing said signal with a reference value, said system 7 will be capable of establishing whether the self-moved device 1 is correctly positioned with respect to said wire 20, and optionally of correcting its position by acting on said moving system 6.

Thanks to this, the self-moved device 1 is made capable of moving along said wire 20 and therefore of following the set path. Activation of the spraying system 5 is it also controlled by the management system 7 on the basis of the signals received by said sensor, thereby making it possible to carry out the spraying of the paint to the extent of said set path. Optionally, along said path there may be provided stretches of partial shielding or alteration of the magnetic field produced by the wire 20, at which stretches the spraying is to be interrupted; this would allow to make, e.g., a broken line instead of a solid one.

Alternatively, two or more lead wires 20 may be used, located so as to define a region enclosed therebetween. Thanks to said sensor and to said management system 7, the self-moved device 1 will be programmed to move inside said region enclosed between the wires 20 so as to perform the paint spraying on a region instead of along a line, thereby making a graphic element.

Another guidance system provides the use of a remote control allowing a user to remotely send signals to the self-moved device 1. These signals are processed by said management and control system 7, and then cause activation of said moving system 6 and of said spraying system 5. In particular, by means of said remote control the user could drive the self-moved device 1 on the surface 50 and perform the spraying on the desired spots, optionally with the option of choosing the colour to be sprayed.

Figure 3B:
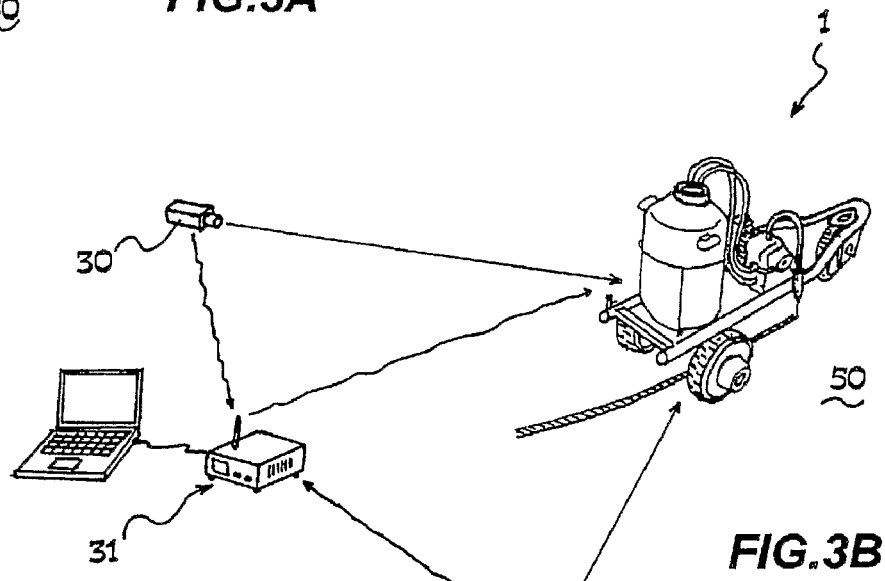
FIG. 3B shows the self-moved device of FIG. 1 with a camera-fitted guidance system.

A further guidance system, shown in FIG. 3B, provides a control system based on cameras 30, which are apt to frame the surface 50 to be sprayed along axes, e.g., orthogonal therebetween. The signals produced by said cameras 30 are processed by a software in order to detect the position of the self-moved device 1 onto the surface 50 itself.

Still by means of a software, said detected position is compared with information in digital format concerning the design or graphic element to be made, information that have been provided in advance to the control system; depending on the outcome of said comparison (position in which the spraying is provided or not provided), the management and control system 7 could activate the spraying system 5 (optionally selecting also the colour or the substance to be sprayed) in that position and/or act onto the moving system 6 to direct the self-moved device 1 to a new position in which said spraying is required.

The processing of said signals coming from the cameras 30 could be performed directly by the management and control system 7 present in the self-moved device 1, e.g. in communication with said cameras 30 by means of a wireless system; alternatively, it could be performed by a processing unit 31 not incorporated into the self-moved device 1, yet communicating therewith by means of a wireless system.

Therefore, the described camera-fitted guidance system allows to automatically and repeatably make also complex and multi-colour graphic elements.

The same camera-fitted guidance system may be suitably modified to be used even in the training stage, as described hereinafter. By means of the above-mentioned remote control, a user controls the self-moved device 1 to make the required pattern. This step is shot by the cameras 30, whose signals are processed and stored by an electronic system, thereby obtaining a digital representation of the pattern to be made and of the sequence of motions that have to be performed by the self-moved device 1. Then, the same pattern could be identically reproduced on other surfaces, obviously again with a camera-fitted guidance system, requiring no operator's intervention anymore.

Figure 3C:
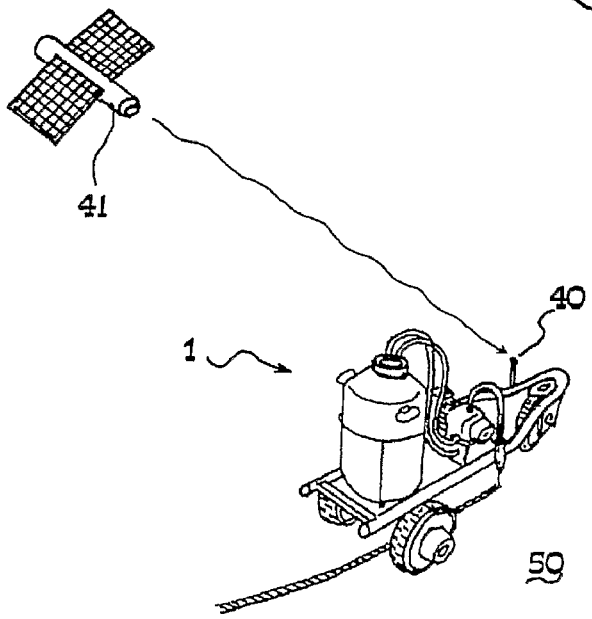
FIG. 3C shows the self-moved device of FIG. 1 with a satellite guidance system.
Figure 4:
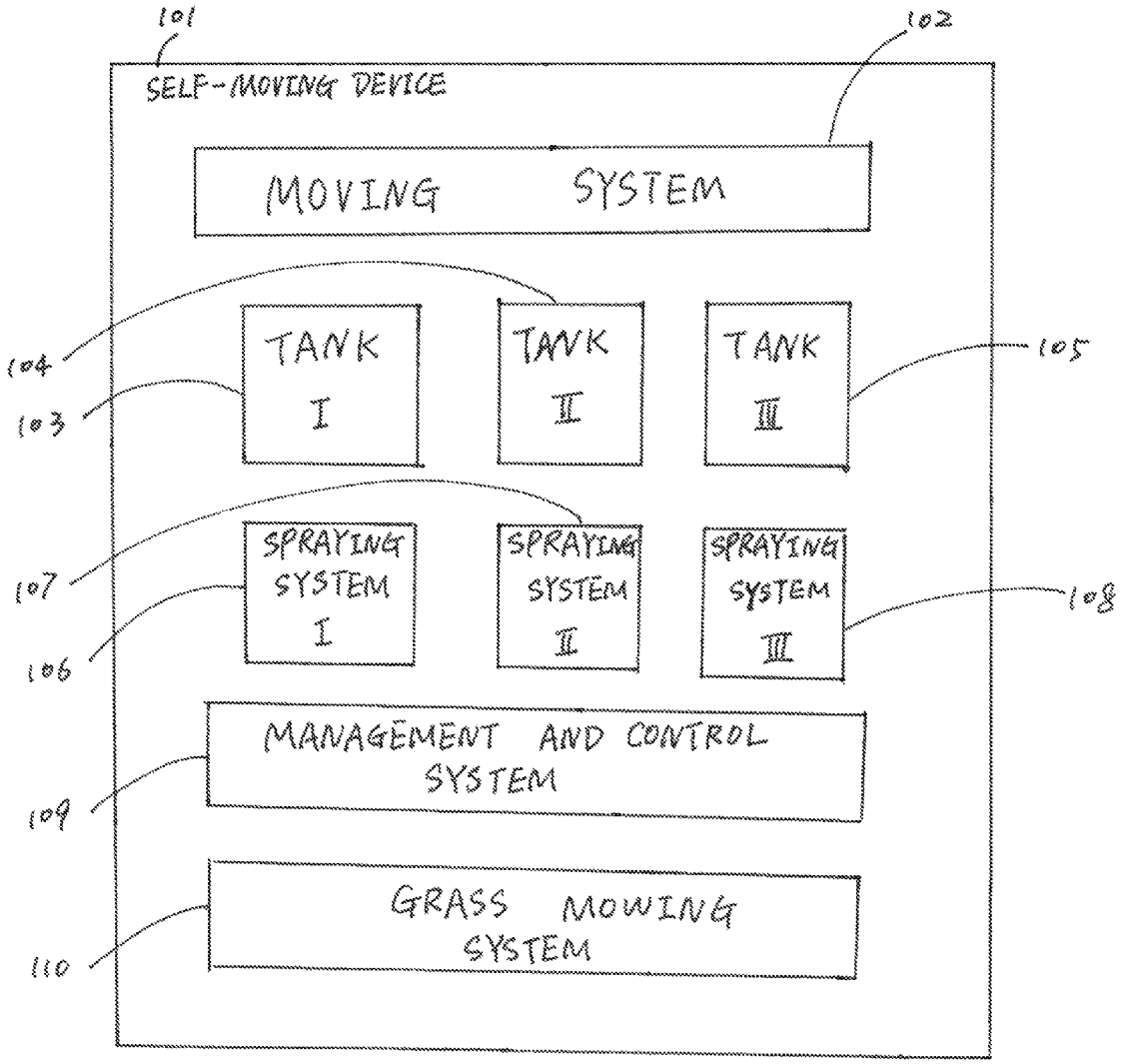
FIG. 4 shows a diagram generally illustrating a self-moving device (101) comprising a moving system (102), a plurality of tanks (103-105) and spraying systems (106-108), a management and control system (109) and a grass mowing system (110).

In a further guidance system, shown in FIG. 3C, the above-mentioned cameras 30 are replaced by a satellite guidance system, in which the signals coming from a satellite 41, e.g. of GPS or Galileo system, are picked up by an antenna 40 and used to reckon the position of the self-moved device 1 with respect to the surface 50. Similarly to what has been described above, comparison between the detected position and the stored information in digital format related to the pattern or graphic element to be made causes activation of the spraying system 5 and/or subsequent motion of the self-moved device 1.

Evidently, also in the case of satellite guidance it will be possible to provide a training stage as the one described for the camera-fitted guidance, in which an operator, by means of a remote control, guides the self-moved device 1 during a first making of the desired pattern, along which an electronic system records, processes and stores information in order to subsequently automatically make the design itself.

Moreover, in cases in which position reckoning by means of the satellite guidance system is not sufficiently accurate due to the limited resolution of the satellite system itself, there could optionally be provided a path error adjusting system based on the above-described camera-fitted guidance system, which therefore would work as an aid to the satellite guidance system.

The self-moved device 1 may comprise rechargeable batteries 45 for power-supplying the spraying pump or pumps 8 and/or the moving system 6 and/or the management and control system 7 and/or other devices optionally requiring electric power.

The self-moved device 1 can be used on different typologies of surfaces 50, be them earthy, sandy, gravelly, asphalt, concrete, as well as on meadows, roads and squares, both plane and sloping ones.

Said fluid substance to be sprayed could be a liquid substance or a powder to be suspended in a gaseous means.

Moreover, the self-moved device 1 could comprise a grass-mowing system, optionally it also controlled by the same management and control system 7.

The present invention has been hereto described according to a preferred embodiment thereof, given by way of example and not for limitative purposes.

It is understood that other embodiments might be envisaged, all to be construed as falling within the protective scope thereof, as defined by the annexed claims.

The invention claimed is:

1. A self-moved device suitable for spraying a fluid substance on a surface, comprising a moving system for motion on said surface, at least one tank suitable for containing said fluid substance, a spraying system for spraying said fluid substance, and a management and control system for managing and controlling said moving system and said spraying system, wherein said management and control system is suitable i) for processing signals produced by cameras to detect a position of said self-moved device on said surface, said cameras being adapted to frame said surface along framing axes, ii) for guiding the motion of said self-moved device on said surface and iii for activating said spraying system in a plurality of spots of said surface according to a predetermined scheme.

2. The self-moved device according to claim 1, wherein said management and control system is suitable for processing signals coming from a remote control or a processing unit.

3. The self-moved device according to claim 1, wherein said predetermined scheme is processed and/or stored by means of an electronic system coincident or interacting with said management and control system.

4. The self-moved device according to claim 1, comprising a plurality of said tanks.

5. The self-moved device according to claim 4, comprising a plurality of spraying systems suitable for concomitantly spraying fluid substances contained in said plurality of tanks.

6. The self-moved device according to claim 1, comprising pivoting wheels.

7. The self-moved device according to claim 1, wherein said moving system comprises independent wheels and a built-in engine.

8. The self-moved device according to claim 1, wherein said fluid substance is a paint.

9. The self-moved device according to claim 1, wherein said fluid substance is water and/or a fertilizer and/or a herbicide.

10. The self-moved device according to claim 1, wherein said fluid substance comprises a powder.

11. The self-moved device according to claim 1, comprising a grass-mowing system.

* * * * *